United States Patent [19]

Lang et al.

[11] 4,231,328

[45] Nov. 4, 1980

[54] AUTOMATIC STEAM GENERATOR FEEDWATER REALIGNMENT SYSTEM

[75] Inventors: Glenn E. Lang, Winfield Township, Butler County; Milburn E. Crotzer, Monroeville; John S. Fuoto, Irwin, all of Pa.

[73] Assignee: Westinghouse Electric Corp., Pittsburgh, Pa.

[21] Appl. No.: 925,720

[22] Filed: Jul. 18, 1978

[51] Int. Cl.[2] ..... F22B 1/06; F22B 37/42

[52] U.S. Cl. ..... 122/504; 122/32; 122/406 R

[58] Field of Search ..... 122/32, 34, 406 R, 504; 176/63, 65

[56] References Cited

U.S. PATENT DOCUMENTS

| | | | |
|---|---|---|---|
| 3,033,538 | 5/1962 | Iddles et al. | 122/32 |
| 3,114,414 | 12/1963 | Judd | 122/32 |
| 3,941,187 | 3/1976 | Jabsen et al. | 122/34 |
| 4,050,418 | 9/1977 | Watanabe | 122/32 |

*Primary Examiner*—Kenneth W. Sprague
*Attorney, Agent, or Firm*—Daniel C. Abeles; Z. L. Dermer

[57] ABSTRACT

A method of automatically realigning a steam generator secondary piping system, such as the feedwater system, in the event of a pipe break to a given steam generator in a system having plural steam generators sharing, in part, a common secondary piping system. A feedwater line break is identified by monitoring the respective generators' steam exit line pressures and comparing the several pressures to a first predetermined setpoint. If any one of the several monitored pressures falls below the first setpoint the main steam line isolation valves are automatically closed and the respective generator pressures are again monitored and compared to a second predetermined setpoint. The feedwater line to the generator then exhibiting a drop in pressure below the second setpoint is isolated and the remaining generator main steam line isolation valves may be opened to return the functional intact generators to the system.

7 Claims, 4 Drawing Figures

AUTOMATIC STEAM GENERATOR FEEDWATER REALIGNMENT SYSTEM

BACKGROUND OF THE INVENTION

This invention pertains generally to steam generator secondary piping systems, and more particularly to such systems as are shared, in part, among a plurality of steam generators.

Nuclear steam generation systems commonly employ a plurality of steam generators which communicate steam to a common header to drive a single turbine, and in turn, receive feedwater from a common condensate reservoir. Presently, in a number of plants, a secondary line break is detected by monitoring the respective steam exit pressures of the several generators in the system and the corresponding feedwater flow rates. Upon a feedwater line break at the inlet to any of the generators the pressure in the remaining steam generators will similarly drop due to the mutual coupling of steam lines of the several generators at the common header. However, the flow rate to the generators having feedwater lines that remain intact will decrease, while the flow rate through the broken line will increase. Although pressure is monitored in this arrangement the flow rate is employed to identify the line break.

A change in the operation action requirements specified by governmental regulations necessitates that either corrective action for a break be implemented automatically or flow restrictors be employed in the feedwater lines. Flow restrictors are undesirable because they increase the pump capacity required during normal operation. Automation of present procedures employed to correct feedwater line breaks would apply the flow rate signals as a means for implementing the corrective action previously established manually. However, an automated system responsive to the flow rate signals would be highly susceptible to unnecessary reactor trips since the flow rate setpoints would have to be flexibly adjusted to accommodate start-up, shut-down and normal power operation variations.

Accordingly, a new feedwater alignment system is desired that will function to take corrective action in the event of a secondary line break without causing spurious trips.

SUMMARY OF THE INVENTION

Briefly, this invention provides a method of automatically realigning a steam generator secondary piping system in the event of a secondary line break to a given steam generator, in a system having plural steam generators sharing in part a common piping system. The method and system of this invention monitors the steam exit pressure of the several generators and compares the monitored values with a first predetermined setpoint. The system is then responsive to an indication that the pressure in any of the steam generators has dropped below the first setpoint to close the main steam line isolation valves on each of the generators. The steam exit pressures are then again monitored to indicate the generator that drops in pressure below a second preestablished setpoint, thereby identifying the corresponding secondary line break. The system is responsive to the indication that the second setpoint has been reached to close the feedwater isolation valves of the feedwater line associated with the break. The remaining intact generators can then receive feedwater and may be returned to the system.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENT

Figure 1:
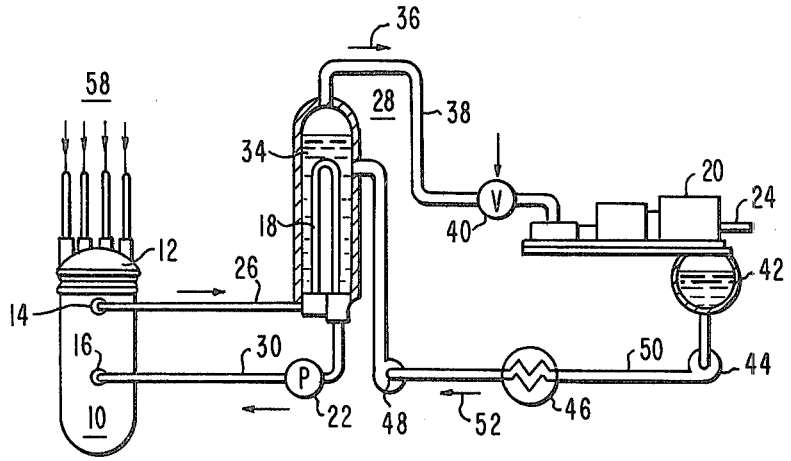
FIG. 1 is a schematic illustration of a nuclear reactor power generating facility.

FIG. 1 shows a schematic representation of a typical pressurized water reactor which can employ the method of this invention to realign the secondary side feedwater system in the event of a secondary line break. The reactor of FIG. 1 includes a vessel 10 which forms a pressurized container when sealed by its head assembly 12. The vessel has coolant flow inlet means 16 and coolant flow outlet means 14 formed integral with and through its cylindrical walls. As is known in the art, the vessel 10 contains a nuclear core consisting mainly of a plurality of clad nuclear fuel elements which generate substantial amounts of heat, depending primarily upon the position of control rods 58. The heat generated by the reactor core is conveyed from the core by coolant flow entering through inlet means 16 and exiting through outlet means 14. Generally, the flow exiting through outlet means 14 is conveyed through an outlet conduit 26 to a heat exchange steam generator system 28, wherein the heated coolant flow is conveyed through tubes (schematically illustrated by reference character 18), which are in heat exchange relationship with water, which is utilized to produce steam. The steam produced by the generator 28 is commonly utilized to drive a turbine 20 for the production of electricity. The flow of the coolant within the primary reactor system is conveyed from the steam generator 28 by the pump 22 through a cool leg conduit 30 to the inlet means 16. Thus, a closed recycling primary or steam generating loop is provided with the coolant piping coupling the vessel 10 and the steam generator 28. The vessel shown in FIG. 1 is illustrated with one such closed fluid flow system or loop, although it should be understood that the number of such loops varies from plant to plant and commonly two, three, or four are employed. Although not shown in the loop illustrated in FIG. 1, one loop of each plant includes a pressurizer which is responsive to the onset of a variation in pressure within the primary system due to temperature changes and variations in other operating conditions, to maintain a substantially constant primary pressure.

The secondary side of the steam generator is isolated from the primary coolant by the heat exchange tubes 18. in the steam generator the secondary fluid 34 is placed in heat exchange relationship with the primary coolant, whereby the secondary fluid is heated and converted to a vapor or steam. The vapor flows through a steam conduit 38, as denoted by the arrow 36, to a turbine 20 which is connected via shaft 24 to a load, for example an electrical generator. The amount of steam exhausted to the turbine is controlled by a throttling valve 40. The steam, after passing through the turbine 20 is condensed in a condenser 42. The condensate or water thus formed is returned to the secondary, or shell side of the steam generator through conduits 50, condensate pump 44, feedwater heater 46, and feedwater pump 48, as noted by flow arrow 52. Thus, a recycling, secondary electrical generating system is provided with the secondary fluid piping coupling the steam generator 28 to the turbine.

Figure 2:
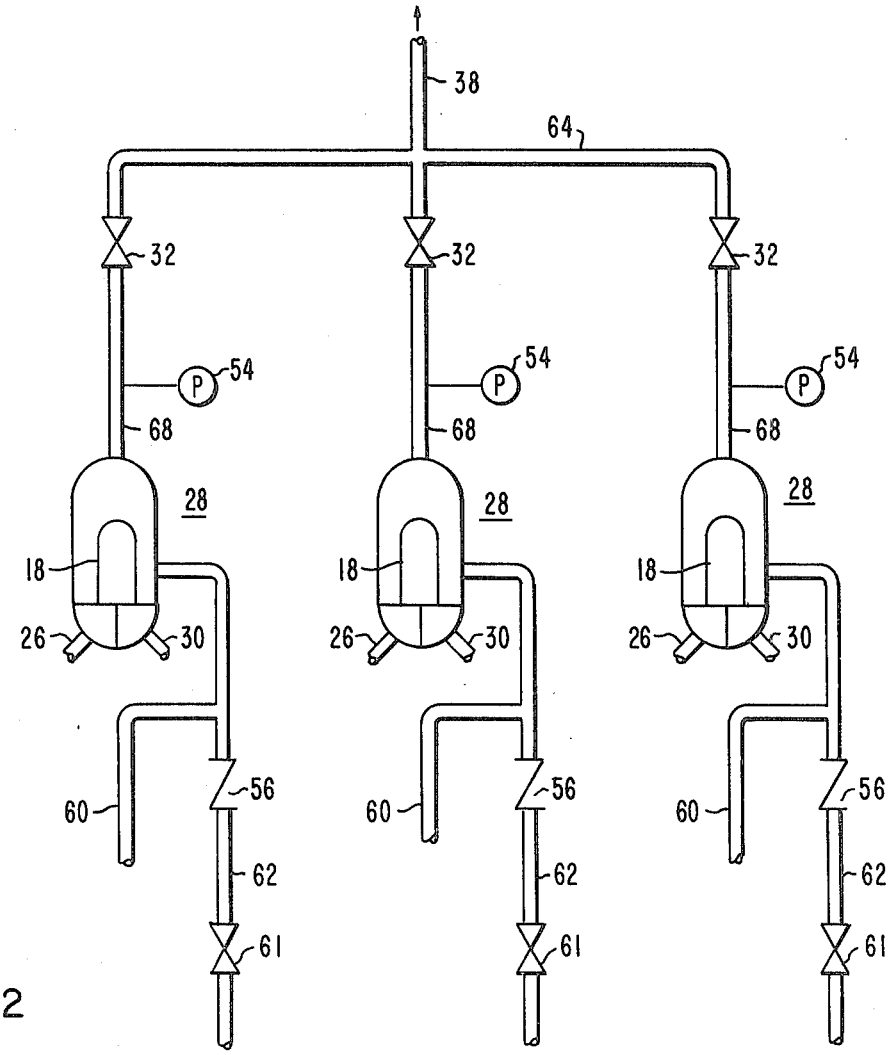
FIG. 2 is a schematic illustration of a typical plural arrangement of steam generators.

As previously stated FIG. 1 illustrates a simplified schematic, and in practice commonly two, three, or four separate primary loops are connected between the reactor and a corresponding number of steam generators. For example, FIG. 2 illustrates an arrangement employing three loops, and correspondingly, three steam generators. Like reference characters are employed among the various figures to designate like elements. As previously noted the primary coolant is introduced through a corresponding conduit 26 to the hot leg of each steam generator for circulation through a plurality of heat exchange tubes 18, which convey the coolant to the cool leg of the respective generators 30 for recirculation through the reactor. Water on the shell side of the generators is converted to steam as a result of the heat communicated by the primary coolant circulating through the heat exchange tubes 18. The steam produced by the several generators is conducted by the main steam lines 68, through isolation valves 32, steam header 64, common steam line 38 to the turbine. On the return side of the turbine, the main source of feedwater is provided through a common header to the several feedwater lines 66 and corresponding isolation valves 61 and check valves 56 to the individual feedwater inlet lines 66 of the several generators. In addition, auxiliary feedwater lines 60 are provided to satisfy low flow conditions, such as occur upon start-up or shut-downof the plant. The auxiliary feedwater is introduced into the feedwater inlet line downstream of the main feedwater line check valve 56.

Figure 3:
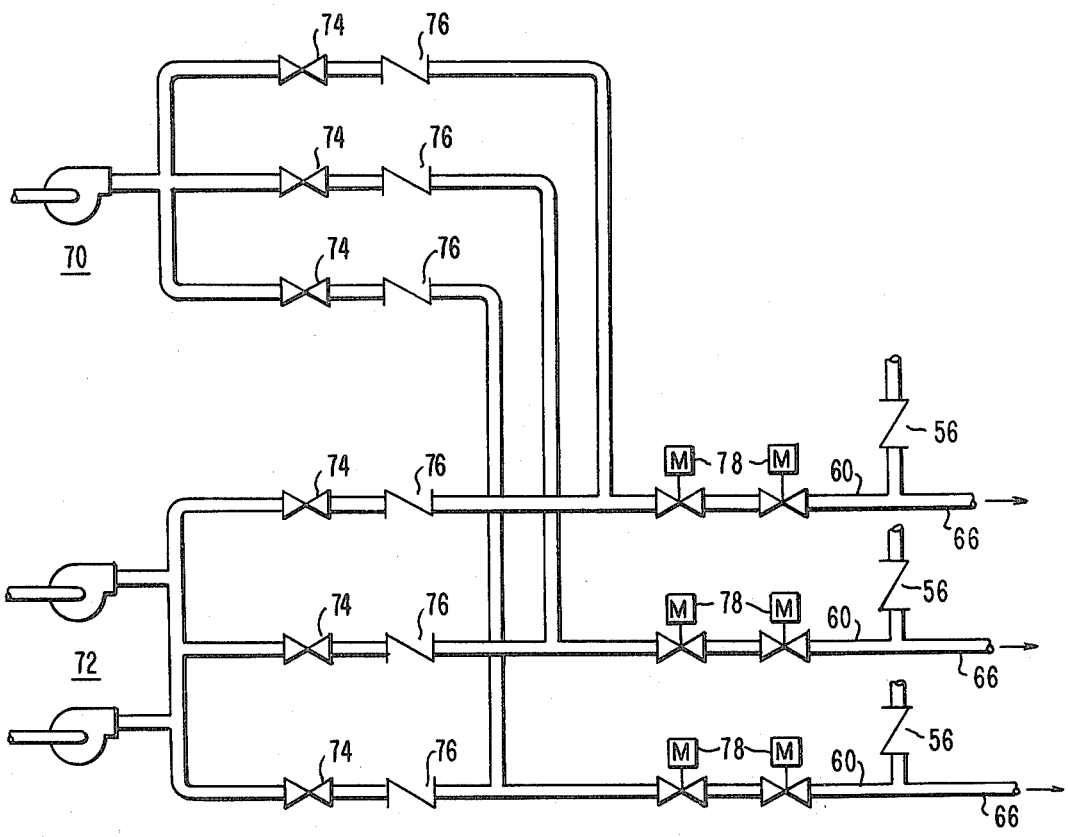
FIG. 3 is a schematic illustration of the auxiliary feedwater system for the generators of FIG. 2.
Figure 4:
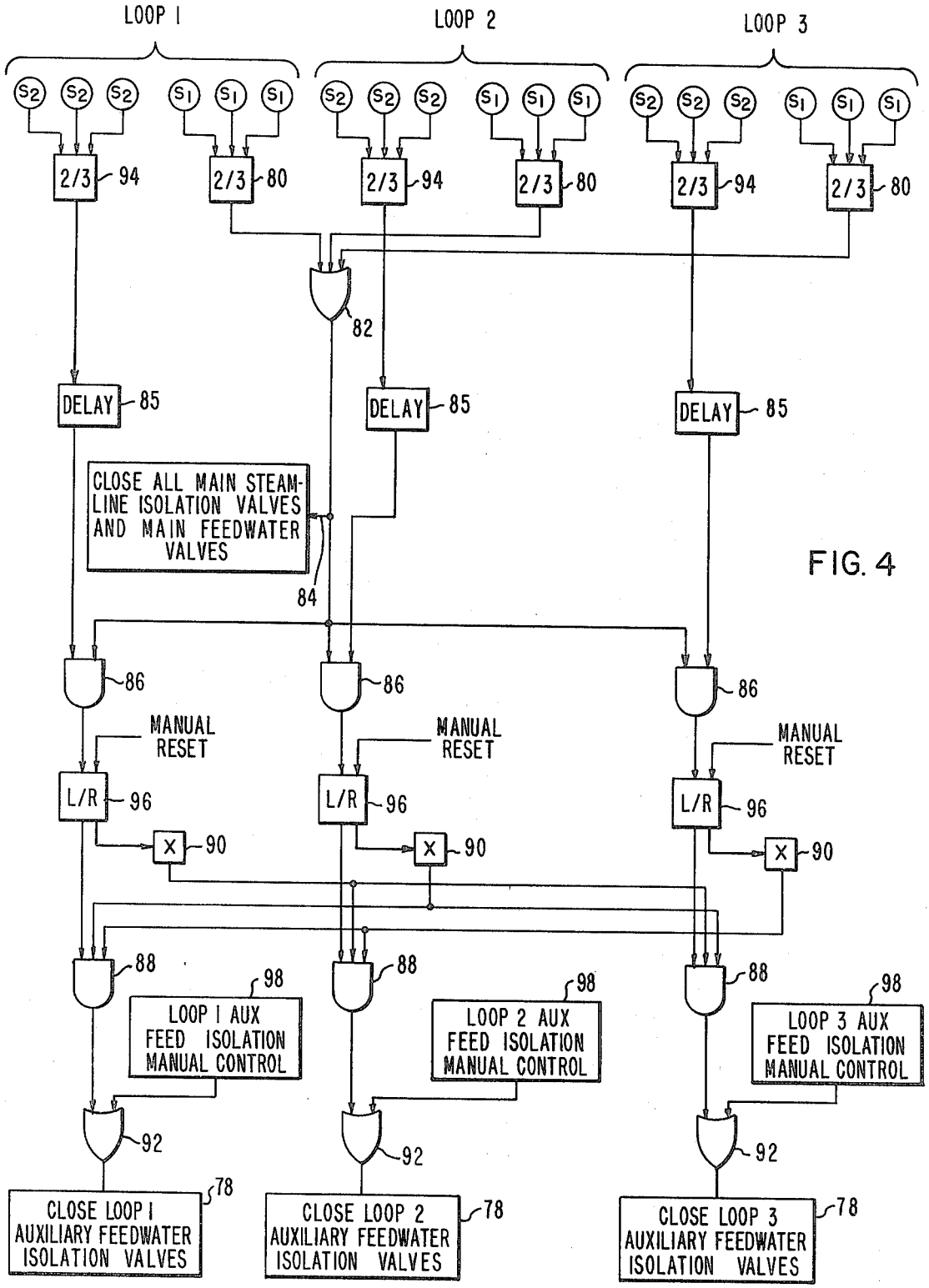
FIG. 4 is a schematic circuitry diagram of the system for implementing the method of this invention to realign the feedwater system illustrated in FIG. 3 in the event of a secondary line break.

In the preferred arrangement shown in FIGS. 3 and 4 this invention is applied to the auxiliary feedwater lines of the steam generation system of FIG. 2. Two diverse feedwater pumping systems 70 and 72 are typically employed for safety. The auxiliary feedwater from each of the systems 70 and 72 is directed through a parallel arrangement of flow control valves 74, which are modulated to control the feedwater level within the respective generators. The feedwater exiting the flow control valves 74 is conveyed through corresponding check valves 76, two redundant motor operated shut-off valves 78, to the feedwater inlet lines 66 of the corresponding generators.

Referring to FIG. 2, it can be appreciated that the pressure within each of the main steam lines of the respective generators is monitored by pressure sensors 54. In practice, each pressure tap 54 supplies three separate signals through redundant channels normallyrequired for safety. The pressure signals associated with each channel are communicated in parallel to two separate setpoint bistables, which are connected to the logic circuitry illustrated in FIG. 4. $S_1$ and $S_2$ represent the outputs of the corresponding bistables for each loop.

In accordance with this invention, a break in a secondary line associated with any of the steam generators is identified from the monitored steam exit line pressures of the respective generators by first comparing the monitored parameters to a first predetermined (i.e. 600 psia) setpoint. A setpoint bistable is employed for this purpose. If the pressure within any of the steam generators drops below the first setpoint the corresponding setpoint bistable provides an appropriate output $S_1$, which activates each main steam isolation valve 32 and each main feedwater valve 61 (shown in FIG. 2) to its closed position. The monitored pressures are then compared to a second predetermined setpoint (i.e. 400 psia) by a second set of setpoint bistables. If any of the monitored pressures then drop below the second predetermined setpoint, indicative of the break, the generator corresponding to that monitored pressure is identified by the output of its corresponding setpoint bistables $S_2$, which activates the appropriate valves to isolate the corresponding feedwater line. At the same time, the steam exit lines to the remaining generators may be opened for continued operation of the system at a reduced power level.

Three bistables are provided per loop per setpoint to satisfy the redundancy safety requirements established by governmental regulation. As previoulsy explained, the three pressure signals supplied from the main steam line of each generator are communicated in parallel to the corresponding bistables $S_1$ and $S_2$. To avoid unnecessary trips, the outputs from the three bistables $S_1$ for each of the respective loops are gated by two out of three logic elements 80. The outputs from the several logic elements 80 are in turn connected to the respective units of a common OR gate 82. Should two out of the three bistables $S_1$ within any loop identify that the pressure within the loop had dropped below the first setpoint, then the output of OR gate 82 would communicate a signal 84 to close all the main steam line isolation valves and main feedwater valves on each of the steam generators. If the monitored pressure at the steam exit line of any of the respective generators then indicates that the pressure of that corresponding generator continues to drop to a value below the second setpoint then the corresponding bistables will provide an appropriate output $S_2$. Should two out of three of the bistables $S_2$ in any given loop indicate that the second setpoint has been surpassed after a preselected interval after a command has been generated to close the main steam line valves, two-out-of-three logic element 94 will then provide an appropriate output to AND gate 86, which in turn will be communicated through AND gate 88 and OR gate 92 to the appropriate auxiliary feedwater valve controls for closing the corresponding motor operated valves 78 in each logic train (provided for redundancy) associated with the generator exhibiting the continued drop in pressure below the second setpoint. AND gate 86 also receives an input signal from the output of OR gate 82 to confirm that the steam line isolation valves have been directed closed, to avoid erroneous auxiliary feedwater valve commands. The output of each AND gate 86 is inverted and coupled to a corresponding input on the AND gates 88 associated with the other loops to prevent closing of the auxiliary feedwater valves in more than one loop at a time. OR gate 92 is provided to alternatively permit manual control of the auxiliary feedwater isolation valves in the respective loops and manual reset 96 permits resetting the system in the event of spurious signals. The output of logic element 94 is blocked by switching module 85 from being communicated to AND gate 86 for a preselected time interval after a command has been generated to close the main steam line valves to prevent the system from erroneously responding to transients resulting from the main steam line valve closings.

Thus, in accordance with this invention, should two out of the three pressure signals from any steam generator fall below the first predetermined setpoint, all the main steam line isolation and feedwater valves will close. This action prevents the steam in the intact secondary loops from blowing out of the ruptured line and contains the feedwater system. The steam generator having the broken secondary line will continue to blow down until equilibrium pressure is attained. When this pressure falls below the second preselected setpoint an auxiliary feedwater isolation signal is generated to isolate the ruptured pipe from the common portions of the feedwater system. The system logic is designed to prevent the auxiliary feedwater motor operated valves in the remaining intact loops from closing. At all times the operator has the option to override the automatic isolation signals, both through the manual reset 96 and the manual control 98. In this way, the method of this invention realigns thefeedwater system in the event of a secondary line break in a portion of the system not shared in common among the several generators, to provide the capability of continued operation of the remaining intact steam generators. An indication that more than one generator dropped in pressure below the second predetermined setpoint would signify that the pipe break occurred in a common header shared by several generators and appropriate action could then be taken. It should be further appreciated that though the aforegoing example applied this invention to identifying a feedwater line break, the invention will similarly indicate a corresponding steam line break.

We claim:

1. A method of automatically realigning a steam generator secondary piping system in the event of a pipe break to a given steam generator in a system having plural steam generators sharing in part a common piping system comprising the steps of:

monitoring the pressure in the respective steam generator steam exit lines and providing corresponding electrical outputs representative of the pressure monitored;

comparing the respective monitored outputs to a first predetermined setpoint and identifying through a corresponding second electrical output when any of the respective monitored values drops below the first setpoint;

closing the steam exit lines to the respective steam generators in response to the second electrical output;

comparing the respective monitored outputs to a second predetermined setpoint after the steam exit lines are closed;

identifying from the second setpoint comparison the respective monitored value that drops below the second setpoint and the corresponding steam generator, through a third electrical output; and closing the feedwater line to the steam generator exhibiting the drop in pressure below the second setpoint, in response to the third electrical output.

2. The method of claim 1, including the step of opening the steam exit lines to the respective steam generators not exhibiting the drop in pressure below the second setpoint, in response to the third electrical output.

3. The method of claim 1 wherein the second setpoint equals two-thirds of the value of the first setpoint.

4. The method of claim 1 wherein the first setpoint corresponds to a pressure of 600 psia.

5. The method of claim 1 including the step of blocking the feedwater isolation valves in the remaining steam generators not exhibiting the first drop in pressure below the second setpoint from being closed in response to the third electrical output.

6. The method of claims 1 or 2 wherein all of the steps are performed automatically.

7. The method of claim 1 including the step of blocking the third electrical output for a preselected time interval after the generation of the second electrical output to prevent the system from erroneously responding to transients.

* * * * *